US007093677B2

(12) United States Patent
Hofmann

(10) Patent No.: US 7,093,677 B2
(45) Date of Patent: Aug. 22, 2006

(54) PERCUSSION DRILL HEAD

(75) Inventor: Frank Hofmann, Attendorn (DE)

(73) Assignee: Tracto-Technik GmbH, Lennestadt (DE)

( * ) Notice: Subject to any disclaimer, the term of this patent is extended or adjusted under 35 U.S.C. 154(b) by 150 days.

(21) Appl. No.: 10/471,967

(22) PCT Filed: Mar. 14, 2002

(86) PCT No.: PCT/EP02/02870

§ 371 (c)(1),
(2), (4) Date: Jan. 29, 2004

(87) PCT Pub. No.: WO02/077406

PCT Pub. Date: Oct. 3, 2002

(65) Prior Publication Data

US 2004/0112638 A1 Jun. 17, 2004

(51) Int. Cl.
*E02D 29/00* (2006.01)

(52) U.S. Cl. ..... 175/62; 175/299; 175/305; 175/414

(58) Field of Classification Search ..... None
See application file for complete search history.

(56) References Cited

U.S. PATENT DOCUMENTS 3,865,200 A 2/1975 Schmidt ..... 175/19
4,133,395 A 1/1979 Schmidt ..... 175/22
4,221,157 A 9/1980 Schmidt ..... 91/416
4,938,297 A * 7/1990 Schmidt ..... 175/19

FOREIGN PATENT DOCUMENTS

| | | |
|---|---|---|
| DE | 2 157 259 | 11/1972 |
| DE | 25 58 842 | 7/1977 |
| DE | 26 34 066 | 9/1984 |
| DE | 35 33 995 C2 | 1/1988 |
| DE | 198 04 919 A1 | 8/1999 |
| EP | 0 964 133 A1 | 12/1999 |

OTHER PUBLICATIONS

International Search Report re PCT application No. PCT/EP02/02870 dated Jun. 10, 2002.

International Examination Report re PCT application No. PCT/EP02/02870 dated Jun. 20, 2003.

* cited by examiner

*Primary Examiner*—Zakiya W. Bates
(74) *Attorney, Agent, or Firm*—Cook, Alex, McFarron, Manzo, Cummings & Mehler, Ltd.

(57) ABSTRACT

The invention relates to a method for horizontal drilling with a percussion implement and a percussion head or percussion head element mounted in a movable manner relative to the percussion implement, the percussion impulse being transmitted in at least three steps.

11 Claims, 6 Drawing Sheets

PERCUSSION DRILL HEAD

CROSS-REFERENCE TO RELATED APPLICATIONS

The invention relates to a drill head and a method for percussive drilling implements in the field of horizontal drilling technology and claims the priority of German Patent Application 101 12 985.8, to which reference is made with regard to contents.

BACKGROUND

During horizontal drilling with a percussion implement, a hammer provided in the percussion implement is accelerated, for example with a source of pressure medium, such as water, air or other media. The kinetic energy of the hammer is directed without retardation into the drill head during the driving of the drilling implement. For the propulsion, the mass of the entire drilling implement located in the earth, including the pressure-medium hose, is to be accelerated. Furthermore, the skin friction of the drilling implement with the surrounding earth is to be overcome and displacement work is to be performed in the region of the drill head. All this is performed by the percussion piston.

Difficulties during the driving with such a percussion implement occur in particular in stony or rocky soils, in which the percussion energy partly applied by the skin friction and by the drilling implement mass to be moved is not sufficient in order to direct the shattering energy, required for overcoming an obstacle, into the obstacle, such as, for example, a stone or a piece of rock. This problem has been solved for quite some time by a special configuration of the driving heads ("stepped head"), as described in DE 25 58 842.5 A1.

The percussion energy can thus be directed into the obstacle as concentrically as possible by means of a stepped drill head in order to achieve the requisite shattering energy without the occurrence of substantial disadvantages with the displacement properties of the drill head.

DE 21 57 259 A1 and DE 26 34 066 A1 disclose a driving head which, movable in the axial direction, is connected to the percussion implement. As a result, uncoupling of the forward movement of driving head and percussion implement is achieved, which leads to the entire percussion energy of the percussion piston being available in a first step in the driving head for displacement work and for shattering obstacles. It is not until the obstacle at the face has been overcome, that is to say the path for the driving head is free, that the driving energy of the percussion piston is directed via the driving head no longer solely into the face, but rather a large proportion of said driving energy is directed via the connection between driving head and housing of the percussion implement into the percussion implement, so that the latter is drawn up.

Such a driving head has proved successful in practice and has been used for many years in horizontal percussion driving. However, depending on the dimensioning of the percussion implement or intractability of the obstacle to be overcome, there are practical limits, at given percussion energy, to the use of the driving head described.

BRIEF SUMMARY

The object of the invention, then, is to provide a percussion head which delivers an improved energy output for the driving, in particular in soils abounding in obstacles, and to provide a corresponding method.

The invention is based on the idea of using the percussion energy to be directed into the percussion head in an even more specific manner by energy being introduced in at least three steps.

The object of the invention is achieved by the subject matter of the independent claims. Advantageous designs are the subject matter of the subclaims.

The subject matter of the invention is not restricted to introduction of energy in three steps, since the number of steps can be as large as desired, but is described below with reference to said introduction of energy in three steps.

The introduction of energy in three steps enables the percussion energy to be used in a first step, for example, for overcoming a rocky obstacle essentially for shattering or otherwise for removing the obstacle. This can be realized by two or more elements which are axially movable relative to one another. In this case, "axially" does not mean that the elements have to lie on a geometrical axis. Thus, for example in a steering head, the axes of the impulse path may deviate from the geometrical axis, for example in the steering direction. The percussion energy may in this case be directed into the rock in a highly concentrated point-like manner via a percussion tip arranged in an axially movable manner without proportions of energy being lost for the propulsion of the percussion implement or of the rest of the percussion head. If the obstacle in the region of the percussion-head tip has been overcome, the percussion energy of the piston, in the second step, can be used for the "expansion" of the drill hole preformed in the first step. The preformed drill hole then already has a diameter equal to or greater than that of the machine housing. In the third step, the entire percussion energy can be used for the driving. In this step, the percussion energy, if substantial resistance is no longer to be overcome by the percussion-head tip and the rest of the percussion head, is then directed largely entirely into the body of the percussion implement for overcoming the skin friction and thus for the propulsion.

To this end, the percussion head may have two elements axially movable relative to one another. In this case, the percussion head, in detail, may have a displacement element which is connected to the body of the percussion implement in an axially displaceable manner and a chisel tip (percussion tip) which can be mounted centrally or eccentrically in the displacement element and is connected to the displacement element in an axially movable manner. In this case, the connection between percussion tip and displacement element, on the one hand, and displacement element and body of the percussion implement, on the other hand, has a front and a rear stop, which defines the axial stroke of the respective element of the percussion head.

The displacement element is preferably designed as a displacement ring having a central axial bore for the percussion tip. In particular for steered drilling, however, the displacement element may have a bore deviating from the axis of the drilling implement, either at an angle or parallel to the implement axis.

The percussion tip preferably extends integrally from the tip of the percussion head through the displacement element into the chamber of the percussion piston, in which case the term "integrally" is to be understood in terms of force not in terms of material. Thus the chisel may also be composed of two or more elements frictionally connected to one another.

Furthermore, the chisel or also the further percussion head elements may be held in the contracted basic position by a spring element, so that the axially displaceable percussion head elements return automatically into their basic position after the rapid advance caused by the percussion piston.

The invention is explained in more detail below with reference to an exemplary embodiment shown in the drawing.

Figure 1:
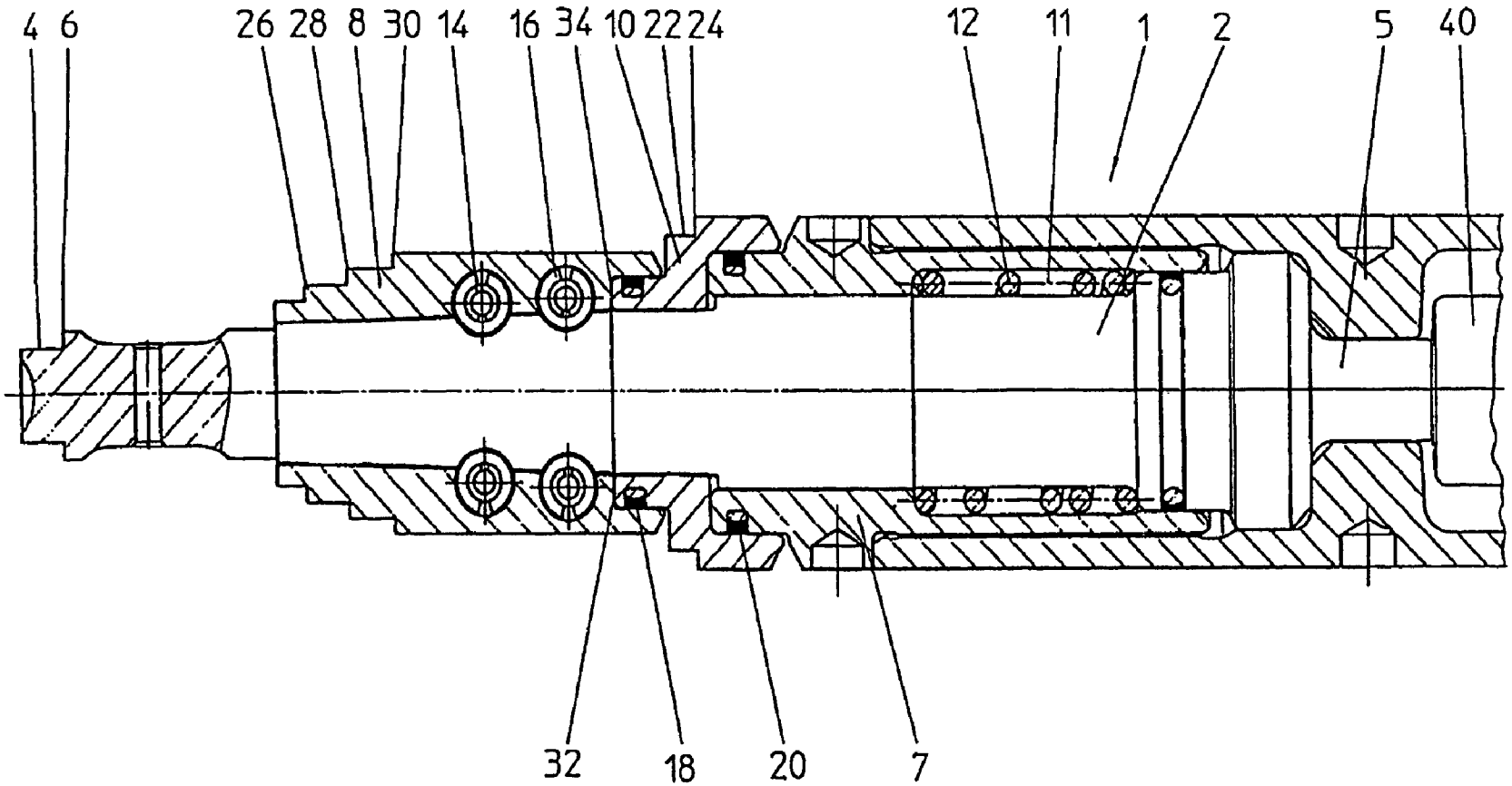
FIGS. 1 to 3 show the percussion head according to the invention in three different functional positions.

The first functional position shows the percussion head in the completely contracted state.

DETAILED DESCRIPTION OF THE EMBODIMENTS

The percussion head 1 has a chisel 2 with a percussion tip 4 and an anvil 5 for the percussion piston 40. The percussion tip has a stepped geometry and a cutting edge 6.

The chisel 2 is arranged in a bore of the base 7, which at the same time serves as an adapter for screwing into the body (not shown) of the percussion implement.

In its front region, the chisel 2 has a stepped attachment 8 which is axially fixed with respect to the chisel and a stepped attachment 10 which is axially displaceable with respect to the chisel. A preloaded spring 12 is provided in an annular space 11 of the percussion head base 7 in order to hold the chisel 2 in its basic position or to press it back into the latter.

Figure 4:
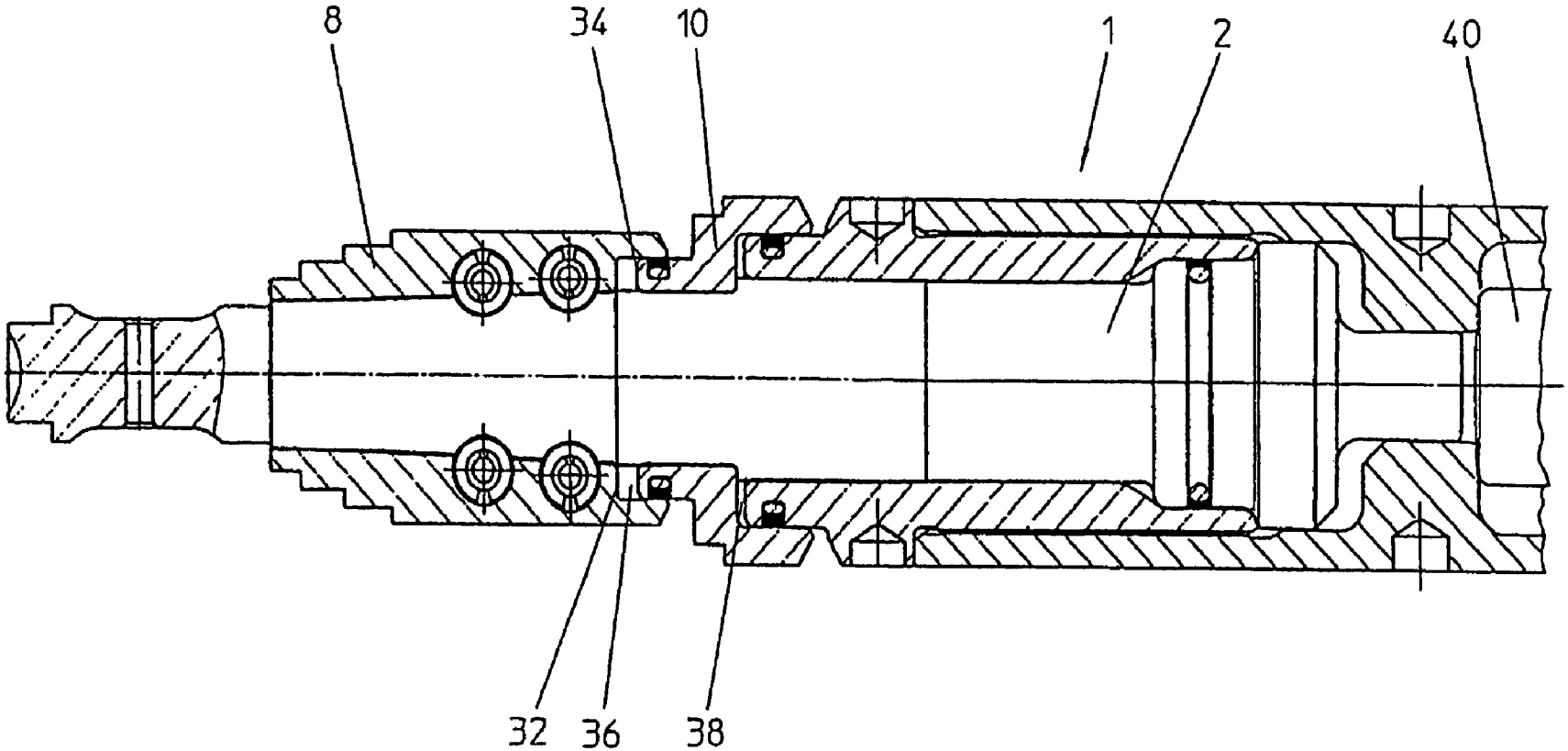
FIG. 4 shows the percussion head according to the invention without restoring spring.
Figure 5:
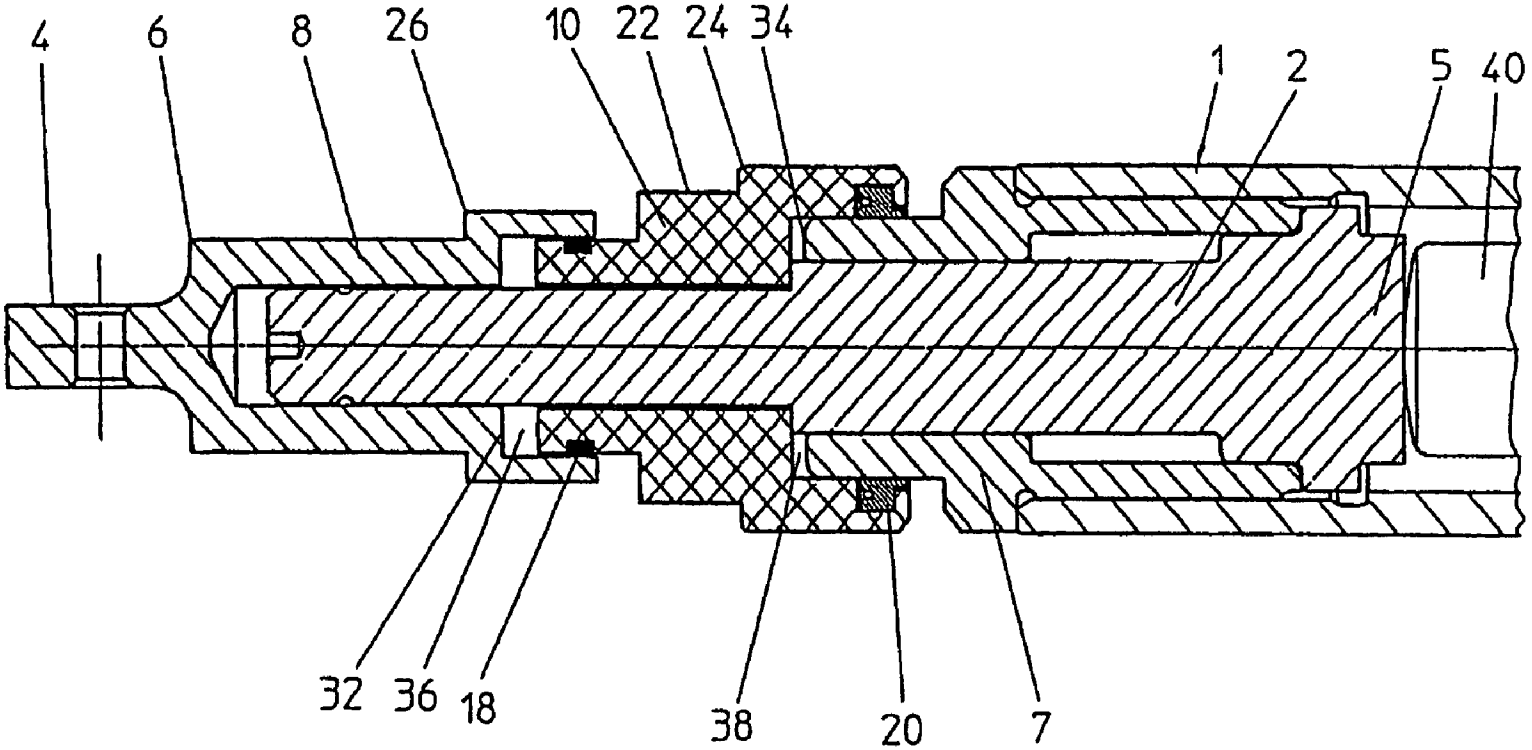
FIG. 5 shows another embodiment of the head according to the invention.
Figure 6:
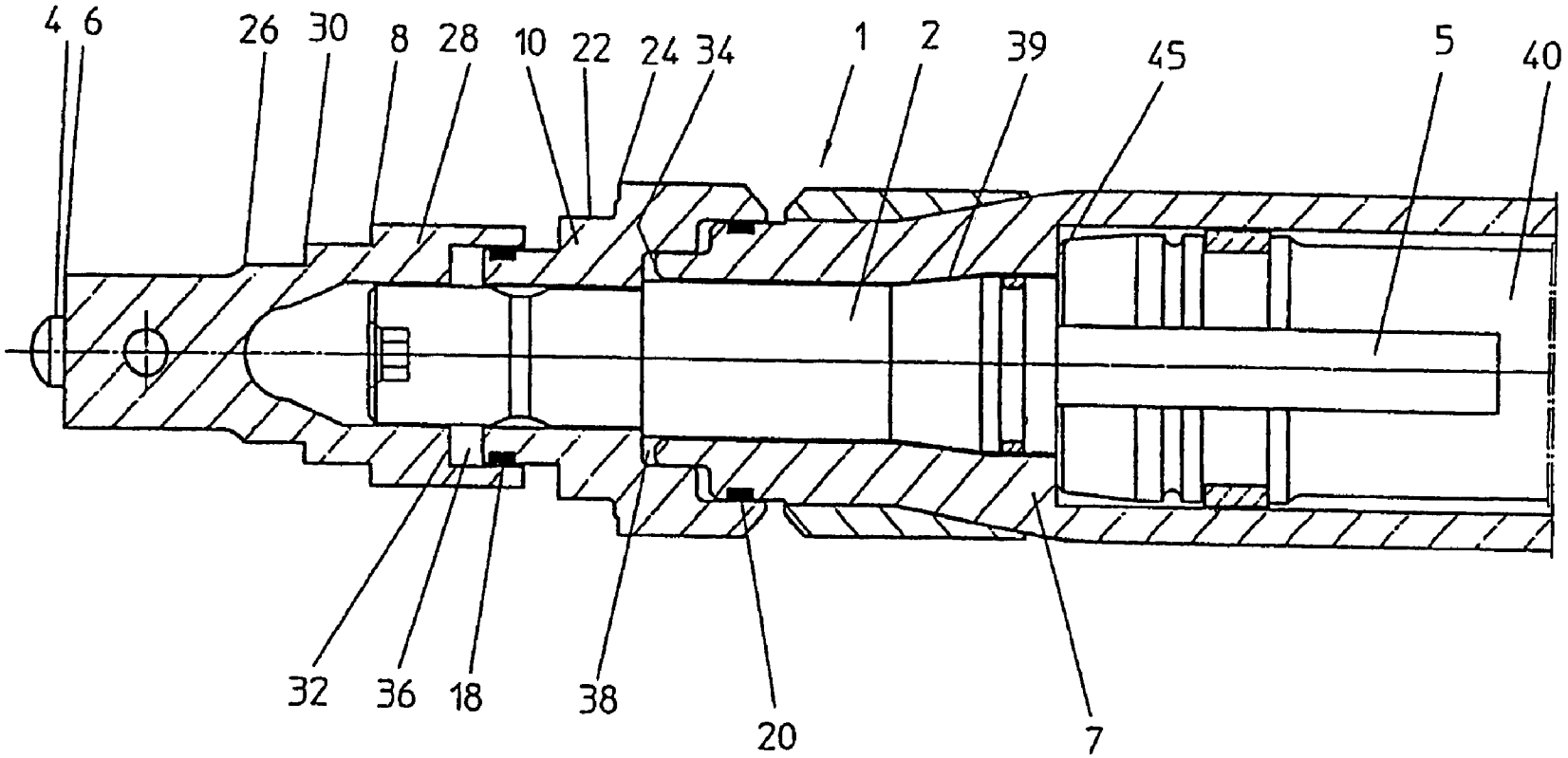
FIG. 6 shows a further embodiment of the head according to the invention.

An embodiment without a spring is shown in FIGS. 4 to 6.

The attachment 8 is fixed on the chisel 2 with pins 14, 16. The attachment 10 is displaceable between a front stop 32 and a rear stop 34 relative to the attachment 8 and relative to the base 7 of the percussion head. The ratio between the step-like displacement sections 22, 24 and 26, 28, 30 establishes in combination with the chisel head 4 the ratio of the force distribution between shattering and displacement work. In the extreme case, the attachment 8 can be omitted, so that the displacement work is performed essentially by the displacement attachment 10. This may also be achieved by the displacement attachment 8 being fixed with respect to the displacement attachment 10 and being axially displaceable with respect to the chisel 2. The attachments 8, 10, which are connected in a sliding-sleeve-like manner, have the sealing means 18, 20 at their connecting points.

Figure 2:
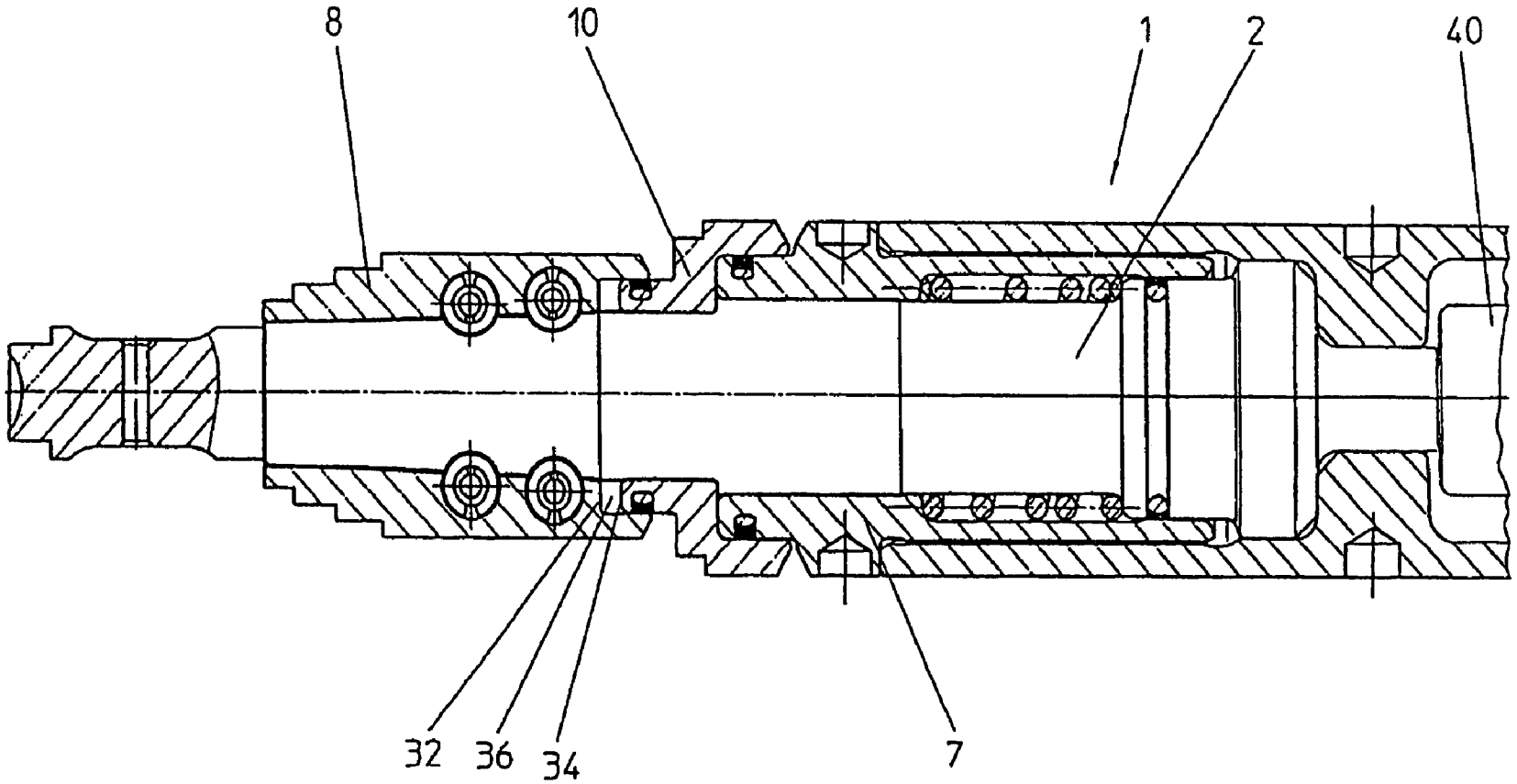
Figure 3:
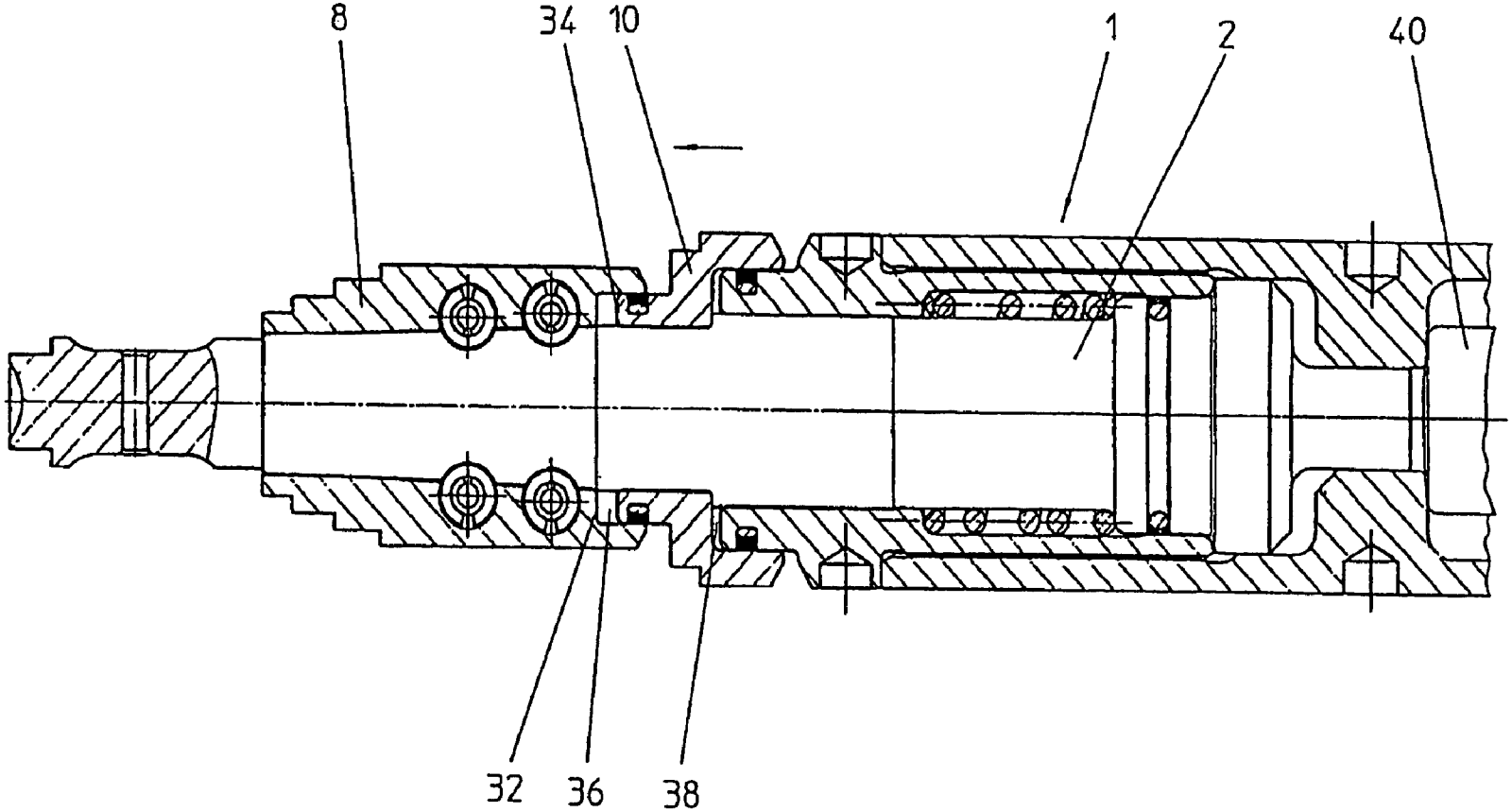

The functional positions shown in FIGS. 2 and 3 show the emergence of the chisel 2 from the percussion head 1 in a first section, in the course of which an annular space 36 is produced, and the emergence of the displacement attachment 10 from the percussion head 1 in a second section, in the course of which an annular space 38 is produced. After the impact, the spring 12 causes the chisel 2 to retract, which at the same time pushes the displacement attachment 10 back with it into its basic position. An embodiment without a spring is shown in FIG. 4, in which embodiment the retraction is effected by the feed which acts on the base 7 and retracts the telescopically extended head.

The embodiments in FIGS. 5 and 6 have a special configuration in the region of the anvil 5. In FIG. 5, the percussion impulse is transmitted from the piston 40 via the chisel 2 to the base 7. In FIG. 6, the percussion impulse is first of all transmitted to the chisel 2 and then via the stop 45 to the base 7, whereas the chisel 2 is limited in the forward direction via the cone 39.

The invention claimed is:

1. A method for horizontal drilling with a percussion implement and a percussion head or percussion head element mounted in an axially movable manner relative to the percussion implement, characterized in that the percussion impulse from the percussion implement into the surrounding soil is transmitted chronologically offset in at least three driving steps.

2. The method as claimed in claim 1, characterized in that the percussion impulse is directed first of all into the tip of the percussion head, then into a central percussion element and finally into the base of the percussion head.

3. A device for horizontal drilling with a percussion implement and a percussion head, characterized in that the percussion head has at least three elements axially movable relative to one another.

4. The device as claimed in claim 3, characterized in that the percussion head has a percussion tip, at least one displacement element for displacing the earth and a base connected to the percussion implement.

5. The device as claimed in claim 4, characterized in that the percussion head has a displacement ring having an axial bore or a bore deviating from the axis, the percussion tip and/or a chisel being mounted in a movable manner in said bore.

6. The device as claimed in claim 5, characterized in that the displacement ring is arranged on the chisel in an axially movable manner.

7. The device as claimed in claim 5, characterized in that the chisel extends integrally in terms of force through the displacement ring into a chamber of a percussion piston.

8. The device as claimed in claim 7, characterized in that the chisel is held in its pushed-back basic position by a spring element.

9. The device as claimed in claim 8, characterized in that the restoring force of the spring element holds the further axially movable head elements in their pushed-back basic position.

10. A method for horizontal drilling with a percussion implement, a percussion piston being arranged within a body of the percussion implement, said percussion piston driving the device by transmitting percussion impulses onto a percussion head, said percussion head having at least three elements which are axially movable relative to one another and which are in contact with the surrounding soil, whereas the percussion impulses are transmitted chronologically offset into each of the elements.

11. A device for horizontal drilling with a percussion implement, a percussion piston being arranged within a body of the percussion implement, said percussion piston driving the device by transmitting percussion impulses onto a percussion head by hitting an element of the percussion head, said percussion head having at least three elements which are axially movable relative to one another and which are in contact with the surrounding soil, whereas the elements of the percussion head are arranged in a way that the percussion impulses are transmitted chronologically offset into the elements.

* * * * *